United States Patent [19]

Tschopp

[11] Patent Number: 4,915,602

[45] Date of Patent: Apr. 10, 1990

[54] PUMP FOR PUMPING A FLUID COMPRISING A LIQUIFIED GAS

[75] Inventor: Claudio Tschopp, Muttenz, Switzerland

[73] Assignee: Cryopump AG, Switzerland

[21] Appl. No.: 192,160

[22] Filed: May 9, 1988

[30] Foreign Application Priority Data

May 19, 1987 [CH] Switzerland ..... 1923/87

[51] Int. Cl.[4] ..... F04B 41/00

[52] U.S. Cl. ..... 417/503; 417/555.1

[58] Field of Search ..... 417/503, 901, 555.1, 417/552, 442, 569, 571

[56] References Cited

U.S. PATENT DOCUMENTS

| | | | |
|---|---|---|---|
| 742,940 | 11/1903 | Whitaker | 417/552 |
| 2,087,663 | 7/1937 | Cardinal | 417/503 |
| 3,016,717 | 1/1962 | Gottzmann | 417/901 |
| 4,239,460 | 12/1980 | Gölz | 417/259 |
| 4,412,792 | 11/1983 | LaBorde et al. | 417/571 |
| 4,639,197 | 1/1987 | Tornare et al. | 417/259 |

*Primary Examiner*—Leonard E. Smith
*Assistant Examiner*—Robert N. Blackmon
*Attorney, Agent, or Firm*—Toren, McGeady & Associates

[57] ABSTRACT

The pump possesses an inlet and an outlet for the fluid to be pumped, a housing bounded at one end by an end member and enclosing an inner space, in which a piston is displaceably guide. The inlet is connected, by way of the end members and by way of a first back-pressure valve, with the pump chamber provided between the end member and the piston, said pump chamber being connected, by way of the end member and a second back-pressure valve, with the outlet. The piston is equipped with a third back-pressure valve, which additionally connects the inlet with the pump chamber, and makes it possible to largely prevent—during the suction strokes and particularly during the beginning phases thereof—any pressure drops from occurring, that could cause in the pump chamber the reconversion of fluid from the liquid to the gaseous state.

16 Claims, 1 Drawing Sheet

PUMP FOR PUMPING A FLUID COMPRISING A LIQUIFIED GAS

BACKGROUND OF THE INVENTION

The invention refers to a pump for pumping a fluid comprising liquefied gas. A pump of this kind is provided with an inlet and an outlet for the fluid and with a housing comprising an inner space, in which a piston is displaceably guided. The pump is also provided with fluid feeding means connecting said inlet with a pump chamber of said inner space provided between an end member of said housing and said piston and comprising a first back-pressure valve, furthermore with fluid abducting means connecting said pump chamber with said outlet and comprising a second back-pressure valve. A pump of this kind, also known as cryogenic pump, may be used for example for pumping a fluid comprising one or more liquefied gases, such as liquid nitrogen, liquid oxygen, liquid argon, or liquid air, and perhaps a small quantity of fluid in the gaseous state. However, the fluid to be pumped should be by preference in the liquid state, at least in the main. The pump should be capable of raising the pressure of the cryogenic fluid lying initially at or slightly above the pressure of the surrounding air, for example, and typically between 0.1 and 0.5 MPa, to a value lying for example between 20 and 50 MPa, or higher.

Single stage cryogenic pumps known on the market comprise an inlet and an outlet for the fluid to be pumped, a housing, a piston guided displaceably within said housing, and a drive device for displacing said piston. An end or bottom member of the housing, disposed on the side of the piston facing away from the drive device, comprises a first back-pressure valve, by way of which fluid supplied to the inlet may be sucked into the pump chamber provided between said end member and said piston. A jacket portion of the housing enclosing the pump chamber is provided at a peripheral location with a passage connected with the outlet of the pump by way of a second back-pressure valve. If during operation the piston moves away from said end member and pumps fluid into said pump chamber, the situation may arise, particularly during the beginning phase of a suction stroke, that—because of the under-pressure generated—a relatively large portion of the liquefied gas will become reconverted to the gaseous state, resulting in disturbed operation of the pump, a considerable disadvantage.

This disadvantage is known to be avoided by interposing a supercharger and making the pump two-staged. A pump of this type is known for example from U.S. Pat. No. 4,639,197, to comprise a housing subdivided by means of a dividing wall into two cylindrical inner spaces, each of which being arranged to accommodate a piston displaceably guided therein. The two pistons are fixedly mounted on a common piston rod passing through a hole of the dividing wall provided with a sealing element, and are connected with a drive device by way of said common piston rod. The piston located further away from the drive device serves, together with a sleeve of the housing enclosing the piston and open at its end facing away from the drive device, as a supercharger for pumping the liquefied gas, through the passages provided in the dividing wall, into the pump chamber associated with the high-pressure compressor. In order to prevent the portion of the piston rod connecting the two pistons of the pump, known from the pump of U.S. Pat. No. 4,639,197, from occupying too much space within the chambers provided between the separating wall and the two pistons, said portion of the piston rod should preferably be considerably thinner than the pistons. However, if it is dimensioned thin, the piston rod will be in considerable danger to break during operation. The dividing wall, the two pistons, and the piston rod portion connecting the two pistons, must be cooled down during operation, from the normal room temperature to temperatures lying—depending upon the fluids to be pumped—around −200° C. Also, a large pressure difference develops during pumping between the supercharger and the pump chamber of the high-pressure compressor. Therefore, the sealing element required for sealing the passage of the piston rod through the dividing wall will be costly to make and susceptible to trouble during operation, especially if the portion of the piston rod that penetrates through the dividing wall is dimensioned relatively thin. Also, even if the piston rod is dimensioned thin, the space requirement of the pump—assuming a prescribed pumping output—will nevertheless increase; in fact, a two-stage pump, per se, requires more space than a single-stage pump of the same pumping output. The features requiring that the essential part of the dividing wall and the jacket of the housing enclosing the piston of the high-pressure compressor be located on the exterior of a vessel containing liquefied gas supplied through the inlet, result in the additional disadvantage of this pump, namely that the high-pressure compressor is not insulated with respect to its surroundings, and the heat generated by friction by the piston of the high-pressure compressor cannot be carried off adequately.

SUMMARY OF THE INVENTION

Hence from what has been explained heretofore it should be apparent that the art is still in need of a pump for pumping a fluid comprising liquefied gas, which is not associated with the aforementioned drawbacks of the state-of-the-art pumps.

It is therefore a primary object of the invention to provide a novel construction of a pump for pumping a fluid comprising liquefied gas, which is not associated with the drawbacks and limitations of the prior art as heretofore discussed and which effectively and reliably fulfills the existing need in the art.

Another and more specific object of the present invention relates to a new and improved pump for pumping a fluid comprising liquefied gas, in which the evaporation of fluid—from the liquid state—in the pump chamber is kept low, while the design of the pump is kept simple, its space requirements low, and any disturbances in the operation of the pump, at a minimum.

Yet a further significant object of the present invention relates to a novel construction of a pump for pumping a fluid comprising liquefied gas, in which, while starting out from the known single-stage pump, the evaporation from the liquid state—in the pump chamber can be kept low without having to insert a supercharger stage in front of the pump chamber.

In order to implement these and still further objects of the invention, the pump previously mentioned as comprising an inlet and an outlet for the fluid, a housing comprising an inner space in which a piston is displaceably guided, furthermore fluid feeding means connecting said inlet with a pump chamber of said inner space provided between an end member of said housing and said piston, and comprising a first back-pressure valve, and fluid abducting means connecting said pump chamber with said outlet and comprising a second back-pressure valve, is provided with the added feature, that the piston comprises a third back pressure valve connecting said inlet with said pump chamber and adapted to admit fluid into said pump chamber.

With these features, the pump according the invention displays a series of advantages. Some of these advantages are as follows. The pump is a single-stage pump of relatively simple design, low space requirements and undisturbed operation. There is no second-stage supercharger required. There result savings in design costs, manufacturing costs, material costs and space costs. The evaporation of fluid—from the liquid state—in the pump chamber is kept within limits, so that the operation remains substantially free of disturbances. This causes additional savings in operational costs. Additional embodiments of the invention are claimed in the claims dependent upon the main claim and display further advantageous features.

BRIEF DESCRIPTION OF THE DRAWINGS

The invention will be better understood and objects other than those set forth above will become apparent when consideration is given to the following detailed description thereof. Such description makes reference to the annexed drawings. In these drawings there show.

DETAILED DESCRIPTION OF THE PREFERRED EMBODIMENTS

Figure 1:
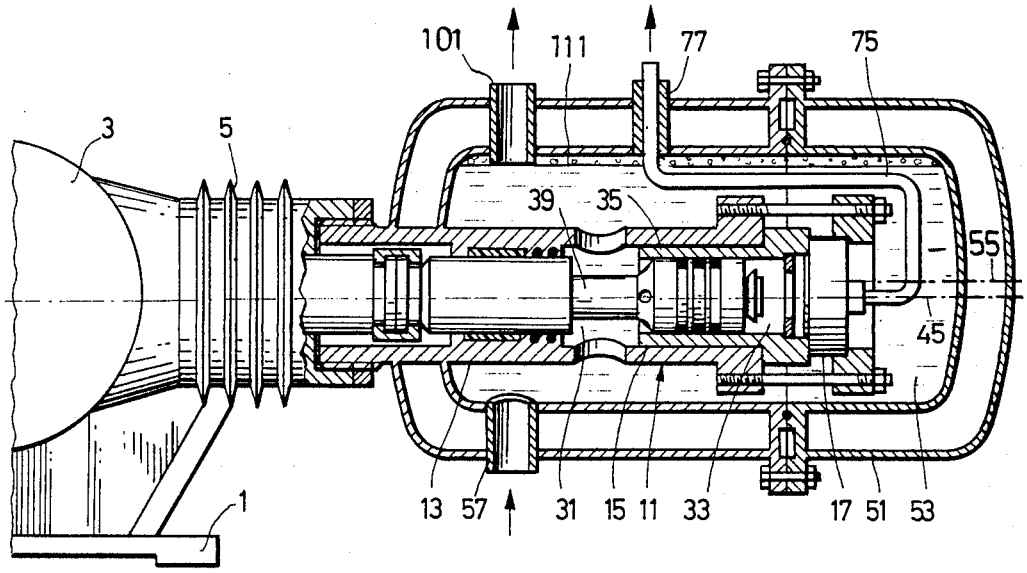
FIG. 1 a pump shown partially in lateral view, partially in vertical section, and FIG. 2 a section through parts of the pump shown in FIG. 1, at a larger scale.

The pump shown in FIG. 1 comprises a base 1 supporting a drive device 3 and a sleeve-shaped connecting piece 5 provided with ribs. Loosenably mounted thereto is an elongated housing, identified as a whole by the reference numeral 11 and comprising a longitudinal shaft 13 built as a continuously open sleeve, the shaft 13 having its one end section screw-connected with the connecting piece 5 and its other end section provided with a circular flange-shaped collar 13*a* protruding radially outwardly. A bushing 15, clearly visible in FIG. 2, comprises a hollow cylindrical case 15*a* inserted into the aforementioned end section of the sleeve-shaped shaft 13 and provided with a collar 15*b* protruding radially outwardly and abutting against the radial end surface of the collar 13*a*. The hollow bushing 15 comprises a cylindrical inner surface 15*c* extending over the greater part of its length and—in its end section facing away from the drive device 3—an enlargement 15*d* followed by a further enlargement 15*e*. The end of the bushing 15 facing away from the drive device 3 is closed off by an end wall of the housing 11 constituting a sepa-end member 17 arranged to comprise a protrusion projecting into said enlargement 15*e* and being sealed by means of ring-shaped seal 19. A clamping ring 21 is loosenably connected with the collar 13*a* by means of fastening elements 23 comprising screw bolts and nuts, and is effective to push the end member 17 against the collar 15*b*, and the latter against the collar 13*a*. As a result, the end member 17 becomes loosenably connected with said bushing, and the latter with said sleeve-shaped shaft 13.

The housing comprises an elongated inner space identified as a whole by the reference numeral 31, the cylindrical part of which, bounded by the bushing 15, has a piston 35 displaceably guided therein and sealed by means of ring-shaped sealing elements 37. The piston is connected to a crank of said drive device 3, by way of a piston rod 39 preferably made of one piece with said piston 35, a section of the shaft 13 being built in the form of a bearing tube 13*b* containing two ring-shaped sealing elements 41, and a cuff-shaped seal 43 for sealing off said piston rod. The shaft 13, the bushing 15, the end member 17, the inner space 31, the piston 35, and the piston rod 39, all have a common horizontal axis 45 or, more accurately, a longitudinal central axis 45, and show substantially rotational symmetry in relation thereto. The region of the inner space 31 disposed between the end member 17 and the piston 35 will be referred to in the following as pump chamber 33.

The largest part of the housing 11 and, in particular, at least the part thereof coming in contact with the piston 35 and guiding it in sealed manner, i.e. the bushing 15, as well as the end member 17 of the housing, are disposed within the inner space 53 of a vessel 51, closed off in sealed manner relative to the surroundings. The vessel 51 possesses heat insulating wall means, comprising an inner wall and an outer wall separated from said inner wall by an intermediate space preferably evacuated. In other respects, the wall means of the vessel 51 consists of two parts, part one of which being rigidly fastened on the hollow shaft 13 near the connecting piece 5, and part two being loosenably mounted, in sealed manner, on said part one, by means of loosenable fastening members. The lowest portions of the housing 11 are disposed slightly above the lowest location of the inner space 53 of the vessel, whereas the axis 45 of the housing 11 and the piston 53 are disposed within the lower half of the inner space 53 of the vessel, and thus below the horizontal longitudinal central axis 55 of the substantially cylindrical vessel.

A stud serving as inlet 57 for the fluid to be pumped opens, for example, into the lowest region of the vessel 51, into the inner space 53 thereof. The end member 17 possesses one or more passages 59 distributed around the axis 45. Together with the inner space 53 of the vessel, these passages 59 constitute the fluid feeding means 53, 59, that connect the inlet 57 with the pump chamber 33. A plate-shaped valve element 61 possesses a central through-opening 61a coaxial with the axis 45, and is guided within the pump chamber 33, displaceably in the direction of the motion of the piston 35, the stroke of the valve element 61 being bounded on one side by the end member 17, and on the other side by the end of the enlargement 15d facing toward the drive device 3. The passages 59, together with the valve element 61, serve as first back-pressure valve 63, the latter having its valve seat constituted by the flat frontal face of the end member 17 and facing toward the piston 35.

The end member 17 comprises, furthermore, a central passage 65 disposed coaxial with the axis 45 and comprising a section arranged to widen in the direction away from the pump chamber 33 and to constitute a valve seat. A ball-shaped valve element 67 is, for example, movably held within the passage 65 and pushed against the valve seat by a spring 69. The passage 65, together with the valve element 67 and the spring 69, serve as second back-pressure valve 71. A conduit 75 fixedly mounted on the end member and connected tight with the passage 65, and consisting for example of a pipe, is arranged to pass through the inside space 53 of the vessel toward a bushing penetrating through the wall means 51 of the vessel and to form there, together with said bushing, an outlet 77 for the pumped fluid. The passage 65, together with the conduit 75, constitute the fluid abducting means 65, 75, that connect the pump chamber 33 with the outlet 77.

The diameter of the section of the piston rod 39 that adjoins the piston 35 is smaller than the diameter of the piston, or than the diameter of the inner surface 15*c* of the bushing 15. The hollow shaft 13 is provided between the bushing 15 and the bearing section 13*b* with one or more holes 79 penetrating through its casing or, for example, with two or more holes 79 distributed over its periphery. These holes open into a hollow region of the inner space 31 of the housing 11 surrounding the piston rod 39. The piston 35 comprises a blind hole 81 drilled thereinto from its front surface facing toward the pump chamber 33. This hole comprises a mouth section arranged to become conically enlarged toward the end member 17 and to serve as valve seat 83. On its side facing toward the drive device 3 and away from the pump chamber 33, between the cylindrical outer surface of the piston rod 39, the piston is bounded by a conical ring surface, from which inclined holes 85 are drilled into the piston and are arranged to open into the base section of the blind hole 81. In this blind hole 81 is inserted, between the base section thereof and the valve seat 83, a guide member 87 comprising in its central part a bushing-like and/or hub-like central section. From this hub-like section protrude outwardly rib-like or wing-like projections distributed around said hub-like section, the free edges of said projections being pressed into the blind hole 81 to fixedly hold the guide member therein. Also, additional securing means and/or fastening means may be provided, if required, to secure the guide member 87 and to rigidly fasten it within the piston. Between neighboring rib-like or wing-like projections of the guide member are provided channels 89 distributed around the hub-like central section of the guide member. The number of channels 89 is equal for example to the number of holes 85, and may vary, for example, between 4 and 8, depending upon the size of the pump and upon its pumping output. A valve element 91 comprises a disc coaxial with the axis 45, the disc comprising a conical section fitting into the conical valve seat 83 and—on its side facing toward the end member 17—a short cylindrical projection having a diameter slightly smaller than the diameter of the through-opening 61*a* of the valve element 61 of the first back-peessure valve. The valve element 91 is rigidly connected with a bolt 93 and may be built, for example, of one piece therewith. The bolt 93 penetrates through the guide hole 87*a* of the guide member 87, it is guided within the same, parallel to the direction of motion of the piston, and is provided on its end facing away from the valve element 91 with a screw-thread, unto which a nut 95 is screwed. Between said nut and the hub-like central section of the guide member 87 is disposed at least one spring, namely a helical spring surrounding the bolt 93. This helical spring exerts a force, directed away from the end member 17 and toward the drive device 3, onto the nut, and—by way of the bolt 93—onto the valve element 91. The free regions of the blind hole 81, together with the holes 85 and the channels 89, constitute a passage. This passage connects the free region of the inner space of the housing, disposed between the piston 35 and the bearing section 13*b*, through the piston, with the pump chamber 33. The passage constitutes, together with the valve seat 83, the valve element 91, the bolt 93, the nut 95, and the spring 97, a third back-pressure valve 99 enabling the inflow of fluid into the pump chamber 33.

The housing 11 consists substantially of metallic parts, preferably of stainless steel. The bushing 15 may consist for example of hardened stainless steel. The piston 35 may consist for example of a beryllium-copper alloy. The valve element 61 may consist for example of stainless steel, the valve element 67 of a metallic material, such as stainless steel, and/or of polytetrafluorethylene. The valve element 91 may consist of a metallic material, such as beryllium-copper alloy, or copper-nickel alloy known as Monel metal.

During the operation of the pump the inlet is connected for example with a reservoir containing the fluid to be pumped, i.e. the liquefied gas. The pressure prevailing in the reservoir is equal to, or preferably somewhat higher than the pressure of the surrounding air, so that—by the pressure prevailing in the reservoir—the fluid is pressed toward the inlet 57 of the pump and into the inner space 53 of the vessel 51. The vessel 51 is also equipped with a gas discharge 101, the inner end thereof being disposed near the uppermost region of said inner space of the vessel. The gas discharge is connected with the aforementioned reservoir by way of a gas return conduit, or with the surroundings by way of a pressure relief valve, for example. The outlet 77 for the liquefied gas compressed by the pump may be connected for example with an evaporating and filling device serving the purpose of filling the fluid, now gaseous again but greatly compressed, into pressure tanks.

During the operation of the pump, fluid—consisting at least in the main of liquefied gas—flows through the inlet 57 into the inner space 53 of the vessel 51. The liquefied gas will mount in the vessel, up to the level 111 for example. Beyond this level, the fluid will be reconverted into the gaseous state by evaporation, as indicated in FIG. 1 by bubbles. The parts of the housing 11 disposed within the vessel inner space 33, and specifically the bushing 15 and the end member 17, which together constitute the pump cylinder proper, are surrounded during operation by low pressure gas, i.e. by gas fed through the inlet and not yet pumped or liquefied. The friction heat generated during operation in the bushing 15 by the friction of the piston 35, and the heat generated by the friction of the piston rod 39 in the bearing 13*b*, as well as any heat generated within the pump chamber 33 and within the three back-pressure valves, may therefore be given off, to a large part, to the liquefied gas present within the vessel inner space 53 under low pressure. This heat will then be used up as heat of evaporation and carried off from the vessel 51 together with any vapors generated during the process.

During pumping, the drive device is effective to alternately displace the piston 35 back and forth along the horizontal axis 45. If the piston will move during the time interval referred to in the following as the suction stroke, in the FIGS. 1 and 2 to the left, i.e. away from the end member 17, then it will suck fluid—in the manner indicated by the arrows—from the vessel inner space 55, through the first back-pressure valve 63, the holes 79, and the passage of the third back-pressure valve 99, into the pump chamber 33. If the piston will then move, during the time interval referred to in the following as the compression stroke, in the opposite direction, then it will push fluid out of the pump chamber 33, through the second back-pressure valve 71, toward the outlet 77.

The general method of functioning of the pump having been described, some characteristics of the pumping process shall now be explained in more detail. During the compression stroke, in which the piston 35 moves toward the end member 17, the fluid present in the pump chamber will push the valve element 61 against the end member 17 and the valve element 91 into the piston 35 and against the valve seat 83. In consequence, the first back-pressure valve 63 and the third back-pressure valve 99 will be closed, while the second back-pressure valve 71 will be open. The spring 97 is dimensioned to generate a comparatively small force, to just suffice to bring the valve element 91, if no other forces act on it, to come to rest on the valve seat 83. If now, at the end of a compression stroke, the piston is braked to the point of rest, and then, at the beginning of the suction stroke, it is accelerated in the direction away from the end member, then the forces acting on the valve element 91 by virtue of the inertia will endeavour to lift the valve element 91 off its valve seat 83. These forces of inertia are then supported by the pressure head of the fluid present on the left side of the valve element 91. As a result, the third back-pressure valve 99 will open, at the beginning of the suction stroke, very fast. In this way it is possible to largely prevent within the pump chamber, in the particularly critical initial phase of the suction stroke, a pressure drop from taking place, that would cause the evaporation of liquified gas. If both the first and the third back-pressure valves are open, the two together will yield a relatively large flow cross-section, This flow cross-section will be effective to prevent any pressure drops and any evaporation of liquefied gas from taking place. The previously mentioned fact, that heat generated during pumping in the pump chamber 33 and its vicinity by friction and/or in other ways, may be transmitted to the liquefied gas present in the inner space 53 and surrounding the bushing 15 and the end member 17, equally contributes to preventing the evaporation of liquefied gas present in the pumping chamber.

The valve element 91 may be built for example to have the annular surface of its conical section that faces the end member 17 be about flush with the front surface of the piston. Furthermore, the length of the piston stroke may be set in such a way, that at the end of the compression stroke, when the valve element 61 abuts against the end member 17, both the piston and the aforementioned annular surface of the valve element 91 will abut substantially together against the valve element 61. At the same time the projection of the valve element 91 will penetrate into the central opening 61a of the valve element 61. If these conditions are met, then the free volume of the pump chamber will be reduced at the end of the compression stroke to almost zero. As a result, practically no dead space will arise in the pump chamber 33 or between the latter and the valve seats of the three back-pressure valves.

Figure 2:
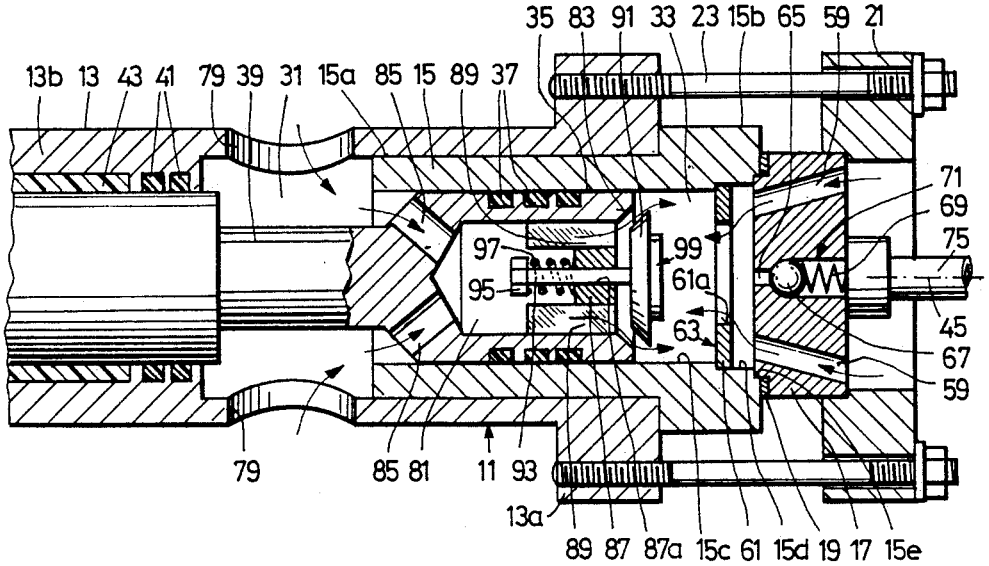

The pump may be modified, of course, in various ways. For example, instead of opening radially into the inner space 53 of the vessel 51, as drawn in FIG. 1, the inlet 57 may be arranged to open into said inner space 53 in a direction parallel to the axis of the piston while penetrating through the end wall of the vessel 51 located on the right in FIG. 1. In this case, a filtering screen may be provided in said inner space of the vessel, between the inlet 57 and the passages of the first and third back-pressure valves. This filtering screen may be designed conical, for example, to provide a large surface area. Also, the design of the three back-pressure valves and of their passages may be modified in many respects. The end member 17 serving as front wall of the housing 11 may be replaced for example by an end member having a larger thickness, as measured in axial direction, and provided on its outer surface with an annular groove arranged to widen from its bottom outwardly. The passages corresponding to the passages 59 could then open into said annular groove, at their ends facing away from the pump chamber 33, rather than opening into the front surface of the end member 17 facing away from the bushing 15, as illustrated in FIG. 2.

Instead, or in addition to the above modifications, there may be provided one or more springs, to exert upon the movable valve element of the first back-pressure valve a force directed away from the piston 35 and toward the end member 17. For this purpose, the valve element of the first back-pressure valve may be provided, for example, on its side facing away from the piston, with at least one finger penetrating into a bore of said end member and having a nut screwed on it at its end facing away from the piston. A helical spring may then be mounted on said finger, and made to engage, at its one end, a radial surface of the end member, and the aforementioned nut at its other end. The bore of the end member that accommodates and guides said finger may be disposed coaxial with the piston, and thus in the position in which the passage 65 of the second back-pressure valve is located in FIG. 2. In this case, the passage of the second back-pressure valve could open into the pump chamber 33 in radial direction, through the wall of the bushing 15.

Furthermore, instead of being of spherical shape the movable valve element 67 of the second back-pressure valve may have a different shape, for example the shape of a sleeve closed off by an end plate at its end facing toward the valve seat, and having its other end open and engaged by a spring corresponding to the spring 69.

The guide member 87 serving for guiding the bolt 93 of the third back-pressure valve may be realized as a bushing provided at its periphery with a continuous cylindrical outer surface. The bushing may be pressed into the blind hole 81, in a manner analogous to that described in conjunction with the guide member 87, and may be fixedly mounted, in addition, by means of securing or fastening devices. The latter devices may comprise for example a set screw, or several set screws distributed below one of the piston sealing elements around the periphery of the piston and screwed into radial screw holes provided in the piston wall. These set screws would be arranged to engage with their ends facing toward the piston axis, and shaped conical for example, into into holes of the bushing that serves as the guide member. The channels 89 visible in FIG. 2 may then be realized as holes distributed around the bushing axis and the bushing hole corresponding to the guide hole 87a.

While there is shown and described present preferred embodiments of the invention, it is to be distinctly understood that the invention is not limited thereto but may be otherwise variously embodied and practiced within the scope of the following claims. According,

What is claimed is:

1. Pump for pumping a fluid comprising liquified gas, the pump comprising an inlet and an outlet for the fluid, a housing with an end member limiting an inner space in which a piston is displaceably guided towards and away from said end member wherein said inner space comprises a pump chamber between said end member and said piston, the pump also comprising fluid feeding means connecting said inlet through said end member with said pump chamber and comprising a first back-pressure valve, the pump further comprising fluid abducting means connecting said pump chamber with said outlet and comprising a second backpressure valve, wherein the piston comprises a third backpressure valve adapted to connect said inlet with said pump chamber wherein said first and third back-pressure valves are adapted to let fluid flow from said inlet to said pump chamber and said second back-pressure valve is closed while said piston is moved away from said end member and wherein the second back-pressure valve is open to permit fluid to flow from said pump chamber to said outlet and said first and third back-pressure valves are closed while said piston is moved toward said end member.

2. Pump as claimed in claim 1, wherein said third back-pressure valve comprises a valve seat fixed in relation to said piston, and a valve element resting, in its closing position, against said valve seat and arranged to be movable away from said valve seat toward said end member.

3. Pump as claimed in claim 2, wherein a spring is provided and adapted to exert upon said valve element of said third back-pressure valve a force directed toward the valve seat of said third back-pressure valve.

4. Pump as claimed in claim 2, wherein the piston possesses a depression on its front side facing said pump chamber, said depression constituting said valve seat of said third back-pressure valve, the valve element of said third back-pressure valve being rigidly connected with a bolt, wherein furthermore a guide hole displaceably guiding said bolt is provided, and said depression is connected with said inlet by way of at least two channels provided in said piston and distributed around said guide hole.

5. Pump as claimed in claim 1, wherein said inlet is connected with a region of said inner space, located on the side of said piston facing away from said end member, and wherein said third back-pressure valve possesses a passage passing through at least one part of said piston and comprising at least one hole that opens into said region of said inner space.

6. Pump as claimed in claim 5, wherein said third back-pressure valve is equipped with at least two of said holes arranged to have their openings, that open into said region of said inner space, distributed around the axis of said piston and around a piston rod connecting said piston with a drive device.

7. Pump as claimed in claim 5, wherein said piston is connected at the end thereof facing away from the end member by a piston rod to a drive device, said housing contains sealing means for sealing said piston rod between said piston and said drive device, at least said end member and a part of the housing having an inner surface thereof in contact with said fluid, are disposed within an inner space of a vessel comprising heat insulating wall means, said housing has between said piston and sealing means at least one hole connecting said inner space of said vessel with said region of the inner space of the housing, said at least one hole of the piston opens in said region where said inlet is connected with said inner space of said vessel and where said inner space of said vessel is connected with at least one passage of said first back-pressure valve and by way of said hole of said housing and piston with said third valve, and said vessel has an outlet for discharging fluid converted to the gaseous state above at least said part of said housing having the inner surface thereof in contact with said fluid.

8. Pump as claimed in claim 7, wherein said piston has a horizontal central axis and at least two of said holes opening into a region of said inner space located around the axis of said piston and around said piston rod, one of said openings located above a section of the piston rod adjacent to the piston and said housing has at least two holes arranged around said axis with one of said holes located at an uppermost point of the housing.

9. Pump as claimed in claim 1, wherein said first backpressure valve comprises at least one passage penetrating through said end member, and a valve element supported displaceably along the direction of motion of said piston.

10. Pump as claimed in claim 1, wherein said fluid abducting means comprise a passage penetrating through said end member and arranged to constitute a valve seat for said second back-pressure valve and to accommodate a movable valve element being part of said second back-pressure valve.

11. Pump as claimed in claim 10, wherein said piston has a longitudinal control axis extending in the direction of motion thereof, a spring engages said valve element of said second back-pressure valve, said passage of said fluid abducting means being disposed coaxial with said axis of said piston, wherein furthermore, said valve element of said first backpressure valve is disposed inside said pump chamber between said end member and said piston, and is arranged to comprise a passage coaxial with said longitudinal central axis of said piston, said first back-pressure valve being arranged to comprise at least two passages penetrating through the end member and distributed around said passage of said fluid abducting means.

12. Pump as claimed in claim 1, wherein at least said end member and a part of the housing with an inner surface thereof in contact with said piston, are disposed within an inner space of a vessel comprising heat insulating wall means, wherein furthermore said inlet is connected, by way of said inner space of said vessel, with said first back-pressure valve and with said third back-pressure valve, and wherein said vessel possesses an outlet for discharging fluid converted to the gaseous state.

13. Pump as claimed in claim 12, wherein said vessel has a horizontal axis, said axis of said piston is horizontal, and is disposed below the horizontal axis of said vessel.

14. Pump as claimed in claim 1, wherein said pump comprises said piston only, to the exclusion of any other piston.

15. Pump for pumping a fluid comprising liquified gas, the pump comprising an inlet and an outlet for the fluid, a housing with an end member limiting an inner space in which a piston is displaceably guided towards and away from said end member wherein said inner space comprises a pump chamber between said end member and said piston, the pump also comprising fluid feeding means connecting said inlet through said end member with said pump chamber and comprising a first back-pressure valve, the pump further comprising fluid abducting means connecting said pump chamber with said outlet and comprising a second back-pressure valve, wherein the piston comprises a third back-pressure valve adapted to connect said inlet with said pump chamber wherein said first and third back-pressure valves are adapted to let fluid flow from said inlet to said pump chamber and said second back-pressure valve is closed while said piston is moved away from said end member and wherein the second back-pressure valve is open to permit fluid to flow from said pump chamber to said outlet and said first and third back-pressure valves are closed while said piston is moved toward said end member, wherein at least said end member and a part of the housing with an inner surface thereof in contact with said piston, are disposed within an inner space of a vessel comprising heat insulating wall means, wherein furthermore said inlet is connected, by way of said inner space of said vessel, with said first back-pressure valve and with said third back-pressure valve, and wherein said vessel possesses an outlet for discharging fluid converted to the gaseous state.

16. Pump for pumping a fluid comprising liquified gas, the pump comprising an inlet and an outlet for the fluid, a housing with an end member limiting an inner space in which a piston is displaceably guided towards and away from said end member wherein said inner space comprises a pump chamber between said end member and said piston, the pump also comprising fluid feeding means connecting said inlet through said end member with said pump chamber and comprising a first back-pressure valve, the pump further comprising fluid abducting means connecting said pump chamber with said outlet and comprising a second backpressure valve, wherein the piston comprises a third backpressure valve adapted to connect said inlet with said pump chamber wherein said first and third back-pressure valves an adapted to let fluid flow from said inlet to said pump chamber and said second back-pressure valve is closed while said piston is moved away from said end member and wherein the second back-pressure valve is open to permit fluid to flow from said pump chamber to said outlet and said first and third back-pressure valves are closed while said piston is moved toward said end member, wherein said inlet is connected with a region of said inner space, located on the side of said piston facing away from said end member, and wherein said third back-pressure valve possesses a passage passing through at least one part of said piston and comprising at least one hole that opens into said region of said inner space, wherein said piston is connected at the end thereof facing away from the end member by a piston rod to a drive device, said housing contains sealing means for sealing said piston rod between said piston and said drive device, at least said end member and a part of the housing having an inner surface thereof in contact with said fluid, are disposed within an inner space of a vessel comprising heat insulating wall means, said housing has between said piston and sealing means at least one hole connecting said inner space of said vessel with said region of the inner space of the housing, said at least one hole of the piston opens in said region where said inlet is connected with said inner space of said vessel and where said inner space of said vessel is connected with at least one passage of said first back-pressure valve and by way of said hole of said housing and piston with said third valve, and said vessel has an outlet for discharging fluid converted to the gaseous state above at least said part of said housing having the inner surface thereof in contact with said fluid.

* * * * *